US010307647B2

(12) United States Patent
Nakamura

(10) Patent No.: US 10,307,647 B2
(45) **Date of Patent: *Jun. 4, 2019**

(54) GOLF CLUB

(71) Applicant: SUMITOMO RUBBER INDUSTRIES, LTD., Kobe-shi, Hyogo (JP)

(72) Inventor: Takashi Nakamura, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/849,170

(22) Filed: Dec. 20, 2017

(65) Prior Publication Data

US 2018/0111026 A1 Apr. 26, 2018

Related U.S. Application Data

(63) Continuation of application No. 14/950,988, filed on Nov. 24, 2015, now Pat. No. 9,901,790, which is a (Continued)

(30) Foreign Application Priority Data

Jul. 23, 2013 (JP) ..... 2013-152337
Feb. 20, 2014 (JP) ..... 2014-030570

(51) Int. Cl.
*A63B 53/10* (2015.01)
*A63B 53/04* (2015.01)
(Continued)

(52) U.S. Cl.
CPC ..... *A63B 53/0466* (2013.01); *A63B 53/00* (2013.01); *A63B 53/14* (2013.01);
(Continued)

(58) Field of Classification Search
CPC ... A63B 53/10; A63B 2209/023; A63B 60/42; A63B 60/00; A63B 53/14; A63B 53/00; A63B 53/0466
See application file for complete search history.

(56) References Cited

U.S. PATENT DOCUMENTS 5,152,527 A 10/1992 Mather
6,478,689 B1 11/2002 Hisamatsu
(Continued)

FOREIGN PATENT DOCUMENTS

EP 2 596 837 A1 5/2013
JP 11-285550 A 10/1999
(Continued)

OTHER PUBLICATIONS

U.S. Appl. No. 14/950,988, filed Nov. 24, 2015; and.
U.S. Appl. No. 14/337,477, filed Jul. 22, 2014.

*Primary Examiner* — Stephen L Blau
(74) *Attorney, Agent, or Firm* — Birch, Stewart, Kolasch & Birch, LLP

(57) ABSTRACT

A club includes a head, a shaft, and a grip. A club length L1 is 43 inches or greater and 48 inches or less. A ratio (Wh/Wc) between a head weight Wh and a club weight Wc is equal to or greater than 0.70. An inertia moment Ix about swing axis is $6.90\times10^3$ (kg·cm$^2$) or greater and $7.50\times10^3$ (kg·cm$^2$) or less. A static moment Mt (kg·cm) of the club is equal to or greater than 16.3 (kg·cm). The frequency of vibration of club is 240 (cpm) or greater and 280 (cpm) or less. The inertia moment Ix (kg·cm$^2$) is calculated by Equation (1):

$$Ix=Wc\times(Lc+60)^2+Ic \quad (1).$$

20 Claims, 4 Drawing Sheets

Related U.S. Application Data continuation of application No. 14/337,477, filed on Jul. 22, 2014, now Pat. No. 9,220,952.

(51) Int. Cl.

| | |
|---|---|
| ***A63B 60/00*** | (2015.01) |
| ***A63B 60/42*** | (2015.01) |
| ***A63B 53/00*** | (2015.01) |
| ***A63B 53/14*** | (2015.01) |

(52) U.S. Cl.

CPC ..... *A63B 60/00* (2015.10); *A63B 60/42* (2015.10); *A63B 53/10* (2013.01); *A63B 2209/023* (2013.01)

(56) References Cited

U.S. PATENT DOCUMENTS

| | | | | |
|---|---|---|---|---|
| 6,582,320 | B2 * | 6/2003 | Fendel | A63B 53/14 473/312 |
| 7,326,125 | B2 | 2/2008 | Moriyama | |
| 7,416,495 | B2 | 8/2008 | Ban et al. | |
| 7,850,542 | B2 | 12/2010 | Cackett et al. | |
| 8,066,583 | B2 | 11/2011 | Rice et al. | |
| 8,678,945 | B2 | 3/2014 | Rice et al. | |
| 8,882,607 | B2 | 11/2014 | Nakamura et al. | |
| 9,630,057 | B1 * | 4/2017 | Fay | A63B 23/1272 |
| 2004/0192462 | A1 | 9/2004 | Ashida et al. | |
| 2006/0009302 | A1 | 1/2006 | Oyama | |
| 2010/0273567 | A1 | 10/2010 | Brekke | |
| 2012/0129622 | A1 | 5/2012 | Naruo et al. | |
| 2013/0095944 | A1 | 4/2013 | Nakamura et al. | |
| 2015/0126297 | A1 * | 5/2015 | Brekke | G01B 5/0023 473/292 |

FOREIGN PATENT DOCUMENTS

| | | | |
|---|---|---|---|
| JP | 2004-201911 | A | 7/2004 |
| JP | 2004-313781 | A | 11/2004 |
| JP | 3735208 | B2 | 1/2006 |
| JP | 2006-312013 | * | 11/2006 |
| JP | 2006312013 | A | 11/2006 |
| JP | 2011-235024 | A | 11/2011 |
| JP | 2013-081688 | A | 5/2013 |

* cited by examiner

GOLF CLUB

CROSS REFERENCE

The present application is a 37 C.F.R. § 1.53(b) continuation of, and claims priority to, U.S. application Ser. No. 14/950,988, filed Nov. 24, 2015, which is a 37 C.F.R. § 1.53(b) continuation of, and claims priority to, U.S. application Ser. No. 14/337,477, filed Jul. 22, 2014. Priority is also claimed to Japanese Application No. 2014-030570 filed on Feb. 20, 2014 and Japanese Application No. 2013-152337 filed on Jul. 23, 2013, the entire contents of which are hereby incorporated by reference in their entirety.

BACKGROUND OF THE INVENTION

Field of the Invention

The present invention relates to a golf club.

Description of the Related Art

It is a flight distance that is an important item to evaluate a golf club.

A golf club that aims for increasing a flight distance is proposed. Japanese Patent Application Laid-Open No. 2004-201911 discloses a wood club in which the mass ratio of a head occupied in the total mass of the golf club is 73% or more and 81% or less. Moreover, a golf club that considers the stability of swings is proposed. Japanese Patent No. 3735208 discloses a golf club in which a moment of inertia ($g \cdot m^2$) about a grip end is 200 or greater and 300 or less and the period (sec) of flexural vibrations is 0.2650 or greater and 0.340 or less.

SUMMARY OF THE INVENTION

Demand for a flight distance performance is more and more increased. A golf club easy to take a swing and excellent in a flight distance performance is demanded. The inventor has found out that the ease of a swing is appropriately evaluated and the flight distance performance can be improved using a new index.

It is an object of the present invention to provide a golf club excellent in a flight distance performance.

A preferable golf club according to an aspect of the present invention includes a head, a shaft, and a grip. A club length is 43 inches or greater and 48 inches or less. A ratio (Wh/Wc) between a head weight Wh and a club weight Wc is equal to or greater than 0.70. An inertia moment Ix about a swing axis is $6.90\times10^3$ ($kg \cdot cm^2$) or greater and $7.50\times10^3$ ($kg \cdot cm^2$) or less. A static moment Mt (kg·cm) of the club is equal to or greater than 16.3 (kg·cm). A frequency of vibration of the club is 240 (cpm) or greater and 280 (cpm) or less. The inertia moment Ix ($kg \cdot cm^2$) is calculated by Equation (1), and the static moment Mt (kg·cm) is calculated by Equation (2):

$$Ix=Wc\times(Lc+60)^2+Ic \quad (1)$$

$$Mt=Wc\times(Lc-35.6) \quad (2)$$

if the club weight is defined as Wc (kg), an axial direction distance from a grip end to a center of gravity of the club is defined as Lc (cm), and a club inertia moment about the center of gravity of the club is defined as Ic ($kg \cdot cm^2$).

Preferably, a ratio (Lg/Ls) is 0.55 or greater and 0.67 or less, if an axial direction distance from a tip end of the shaft to a center of gravity of the shaft is defined as Lg, and a shaft length is defined as Ls.

Preferably, the head weight Wh is equal to or greater than 0.190 kg.

Preferably, a weight of the grip is equal to or less than 40 g.

Another preferable golf club includes a head, a shaft, and a grip. A club length is 43 inches or greater and 48 inches or less. A ratio (Wh/Wc) between a head weight Wh and a club weight We is equal to or greater than 0.70. An inertia moment Ix about a swing axis is $6.90\times10^3$ ($kg \cdot cm^2$) or greater and $7.50\times10^3$ ($kg \cdot cm^2$) or less. A static moment Mt (kg·cm) of the club is equal to or greater than 16.3 (kg·cm).

DESCRIPTION OF THE PREFERRED EMBODIMENTS

In the following, the present invention will be described in detail based on referred embodiments with appropriate reference to the drawings.

It is noted that in the present application, the term "axial direction" means the axial direction of a shaft.

Figure 1:
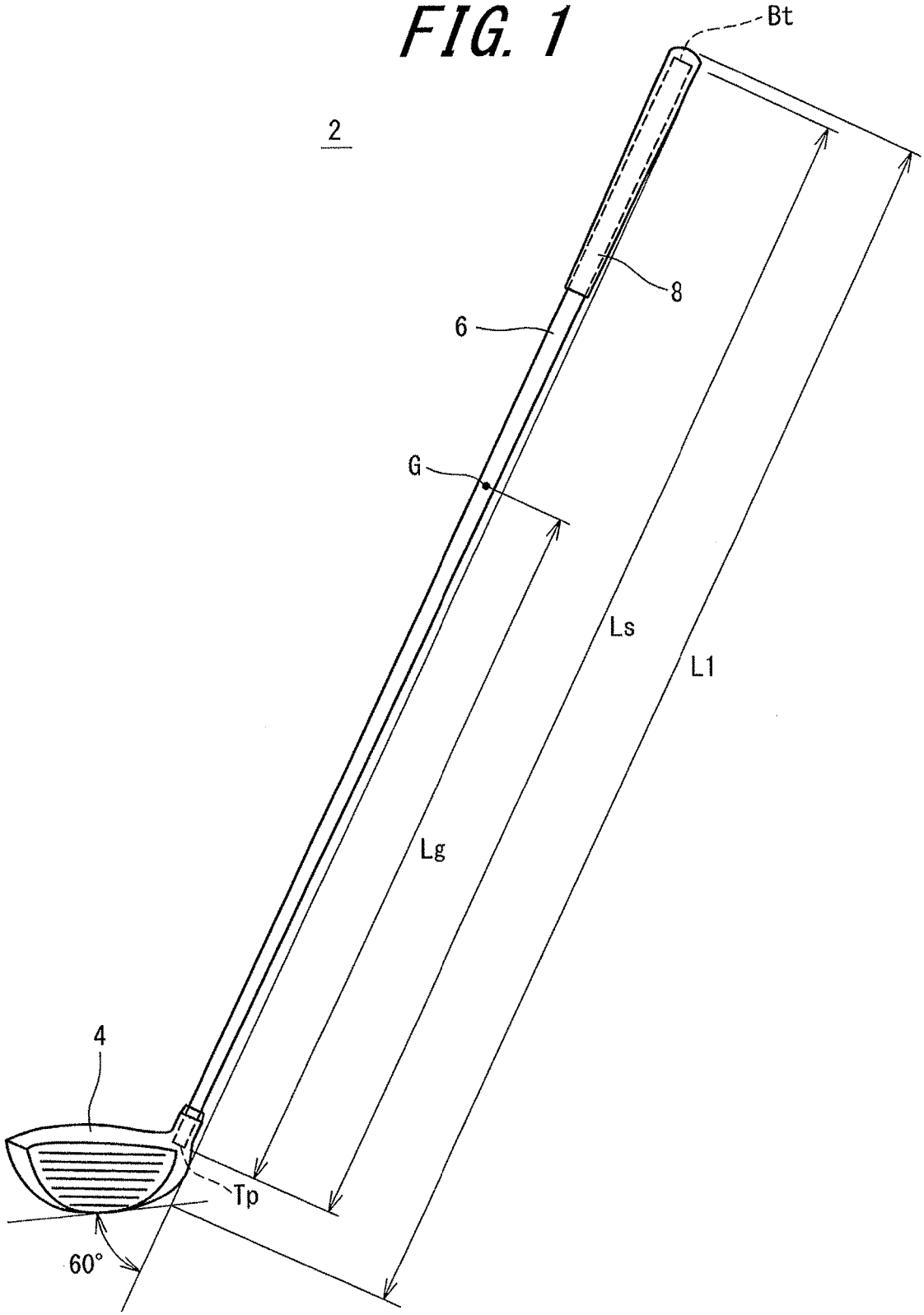
FIG. 1 is a golf club according to an embodiment of the present invention.

A golf club 2 illustrated in FIG. 1 includes a head 4, a shaft 6, and a grip 8. The head 4 is mounted on the tip end part of the shaft 6. The grip 8 is mounted on the butt end part of the shaft 6. The head 4 has a hollow structure. The head 4 is a wood type. The golf club 2 is a driver (a number 1 wood).

The golf club 2 is excellent in a flight distance performance. In consideration of the flight distance performance, preferably, the club length is equal to or greater than 43 inches. From the viewpoint, preferably, the head 4 is a wood type golf club head.

The shaft 6 is formed of a laminate of fiber reinforced resin layers. The shaft 6 has a tubular body. The shaft 6 has a hollow structure. As illustrated in FIG. 1, the shaft 6 includes a tip end Tp and a butt end Bt. The tip end Tp is located in the head 4. The butt end Bt is located in the grip 8.

In FIG. 1, a two-directional arrow Ls expresses a shaft length. The shaft length Ls is an axial direction distance between the tip end Tp and the butt end Bt. In FIG. 1, a two-directional arrow Lg expresses an axial direction distance from the tip end Tp to the center of gravity G of the shaft. The center of gravity G of the shaft means the center of gravity of the shaft 6 alone. The center of gravity G is located on the shaft axis. In FIG. 1, a two-directional arrow L1 expresses a club length. A method for measuring the club length L1 will be described later.

The shaft 6 is a so-called carbon shaft. Preferably, the shaft 6 is formed by curing prepreg sheets. In the prepreg sheet, fibers are aligned substantially in one direction. The prepreg in which fibers are aligned substantially in one direction is also referred to as a UD prepreg. "UD" stands for a uni-direction. It may be fine to use a prepreg other than the UD prepreg. For example, the prepreg sheet may include woven fiber.

The prepreg sheet includes fiber and a resin. The resin is also referred to as a matrix resin. Typically, the fiber is carbon fiber. Typically, the matrix resin is a thermosetting resin.

The shaft 6 is manufactured by a so-called sheetwinding method. In the prepreg, the matrix resin is in a semi-cured state. The shaft 6 is formed by winding and curing prepreg sheets.

The matrix resin used for the prepreg sheet can be an epoxy resin, or a thermosetting resin or thermoplastic resin other than epoxy resins. From the viewpoint of shaft strength, epoxy resins are preferably the matrix resin.

A method for manufacturing the shaft 6 is not limited. From the viewpoint of weight reduction and the degree of freedom for design, a shaft manufactured by a sheetwinding method is preferable.

Figure 2:
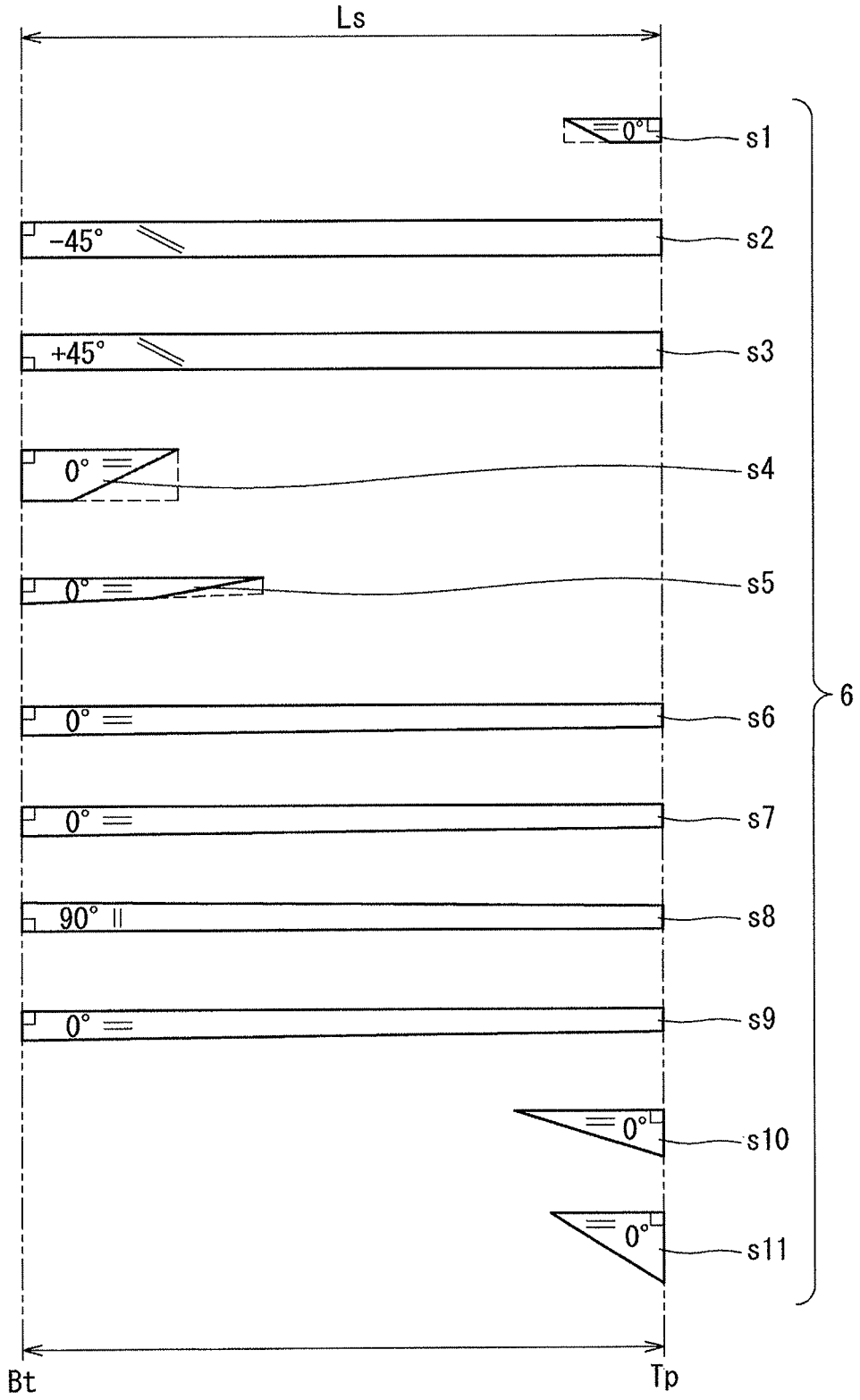
FIG. 2 is a development view of prepreg sheets configuring a shaft used for the club illustrated in FIG. 1.

FIG. 2 is a development view of prepreg sheets configuring the shaft 6 (a configuration diagram of sheets). The shaft 6 is configured of a plurality of sheets. The shaft 6 is configured of eleven sheets from a first sheet s1 to an eleventh sheet s11. The development view illustrated in FIG. 2 illustrates the sheets configuring the shaft in order from the inner side in the radial direction of the shaft. The sheets are wound in order from the sheet located on the upper side in the development view. In FIG. 2, the lateral direction in the drawing corresponds to the axial direction of the shaft. In FIG. 2, the right side in the drawing is the tip end Tp side of the shaft. In FIG. 2, the left side in the drawing is the butt end Bt side of the shaft.

The development view illustrates the order of winding the sheets as well as the disposition of the sheets in the axial direction of the shaft (shaft axial direction). For example in FIG. 2, the tip ends of the sheets s1, s10, and s11 are located at the shaft tip end Tp. For example in FIG. 2, the butt ends of the sheets s4 and s5 are located at the shaft butt end Bt.

In the present application, the term "layer" and the term "sheet" are used. The "layer" is wound, and the term "sheet" is not wound. A "layer" is formed by winding a "sheet". That is, a wound "sheet" forms a "layer". Moreover, in the present application, the same reference numerals and signs are used for the layer and the sheet. For example, a layer formed of the sheet s1 is a layer s1.

The shaft 6 includes a straight layer, a bias layer, and a hoop layer. In the development view of the present application, an orientation angle Af of fiber is denoted in the sheets. The orientation angle Af is an angle with respect to the shaft axial direction.

The sheet having the notation "0 degree" configures the straight layer. The sheet for the straight layer is also referred to as a straight sheet in the present application.

The straight layer is a layer that the fiber orientation is substantially at an angle of 0 degree with respect to the shaft axial direction. Because of errors, for example, in winding, the fiber orientation may not be 0 degree perfectly with respect to the shaft axial direction. Generally, in the straight layer, an absolute angle θa is equal to or less than 10 degrees.

It is noted that the absolute angle θa means the absolute value of the orientation angle Af. For example, the phrase that the absolute angle θa is equal to or less than 10 degrees means that the angle Af is −10 degrees or greater and +10 degrees or less.

The bias layer has high correlations with the torsional rigidity and torsional strength of the shaft. Preferably, the bias sheet includes a pair of two sheets that the fiber orientations are inclined in the opposite directions with each other. From the viewpoint of torsional rigidity, the absolute angle θa of the bias layer is preferably equal to or greater than 15 degrees, more preferably equal to or greater than 25 degrees, and still more preferably equal to or greater than 40 degrees. From the viewpoint of torsional rigidity and flexural rigidity, the absolute angle θa of the bias layer is preferably equal to or less than 60 degrees, and more preferably equal to or less than 50 degrees.

In the shaft 6, the sheets configuring the bias layer are the second sheet s2 and the third sheet s3. As discussed above, in FIG. 2, the angle Af is denoted for the individual sheets. The notations positive (+) and minus (−) in the angle Af express that the fibers in the bias sheets are inclined in the opposite directions with each other. In the present application, the sheet for the bias layer is also simply referred to as a bias sheet. The sheet s2 and the sheet s3 configure the pair of sheets.

In FIG. 2, the inclined direction of the fiber of the sheet s3 is equal to the inclined direction of the fiber of the sheet s2. However, as described later, the sheet s3 is reversed, and stacked to the sheet s2. As a result, the inclined direction (the angle Af) of the sheet s2 and the inclined direction (the angle Af) of the sheet s3 are in the opposite directions to each other.

It is noted that in the embodiment in FIG. 2, the angle Af in the sheet s2 is −45 degrees and the angle Af in the sheet s3 is +45 degrees. Of course, on the contrary, the angle Af in the sheet s2 may be +45 degrees and the angle Af in the sheet s3 may be −45 degrees.

In the shaft 6, the sheet configuring the hoop layer is the eighth sheet s8. Preferably, the absolute angle θa in the hoop layer is set substantially at 90 degrees with respect to the shaft axis. However, because of errors, for example, in winding, the fiber orientation may not be 90 degrees perfectly with respect to the shaft axial direction. Generally, in the hoop layer, the absolute angle θa is 80 degrees or greater and 90 degrees or less. In the present application, the prepreg sheet for the hoop layer is also referred to as a hoop sheet.

The number of layers formed of a single sheet is not limited. The number of ply for a single sheet may be 1 or 2. The number of ply may not be an integer. From the viewpoint of uniformity in the circumferential direction, preferably, the number of ply for the straight sheet may be a natural number.

Although not illustrated in the drawing, the prepreg sheet before used is sandwiched between cover sheets. Generally, the cover sheets include a release paper and a resin film. That is, the prepreg sheet before used is sandwiched between a release paper and a resin film. The release paper is stacked to one surface of the prepreg sheet, and the resin film is stacked to the other surface of the prepreg sheet. In the following, the surface to which the release paper is stacked is also referred to as "a release paper side surface", and the surface to which the resin film is stacked is also referred to as "a film side surface".

The development view of the present application is a diagram that the film side surface is the front side. That is, in FIG. 2, the front side of the drawing is the film side surface, and the back side of the drawing is the release paper side surface. In FIG. 2, lines expressing fiber directions are the same direction in the sheet s2 and the sheet s3, and the sheet s3 is reversed in stacking described later. As a result, the fiber direction of the sheet s2 and the fiber direction of the sheet s3 are opposite to each other. Therefore, the fiber direction of a layer s2 and the fiber direction of a layer s3 are opposite to each other. In consideration of this point, in FIG.

2, the fiber direction of the sheet s2 is described as "−45 degrees", and the fiber direction of the sheet s3 is described as "+45 degrees".

In order to wind the prepreg sheet, first, the resin film is peeled off. The resin film is peeled off, and the surface on the film side is exposed. The exposed surface has tacking property (tackiness). The tacking property is caused by the matrix resin. That is, since the matrix resin is in the semi-cured state, the tackiness is developed. The edge part of the exposed film side surface is also referred to as a wind start edge part. Subsequently, the wind start edge part is applied on a wound object. The tackiness of the matrix resin allows smooth application of the wind start edge part. The wound object is a mandrel or a winding body in which the other prepreg sheets are wound around a mandrel. Subsequently, the release paper is peeled off. Subsequently, the wound object is rotated, and the prepreg sheet is wound around the wound object. As described above, the resin film is first peeled off, the wind start edge part is then applied on the wound object, and the release paper is then peeled off. That is, the resin film is first peeled off, the wind start edge part is applied on the wound object, and then the release paper is peeled off. With these procedures, wrinkles on the sheet and winding failure of the sheet are suppressed. This is because the sheet, to which the release paper is stacked, is supported on the release paper, and is less wrinkled. The release paper has flexural rigidity higher than that of the resin film.

In the embodiment in FIG. 2, a united sheet is formed. The united sheet is formed by stacking two sheets or greater to each other.

In the embodiment in FIG. 2, two united sheets are formed. A first united sheet is formed by stacking the sheet s3 to the sheet s2. A second united sheet is formed by stacking the sheet s8 to the sheet s9. The hoop sheet s8 is wound in the state of the united sheet. This winding method suppresses the winding failure of the hoop sheet. Winding failure includes splits on the sheet, errors of the angle Af, wrinkles, or the like.

As described above, in the present application, the sheets and the layers are classified based on the orientation angle of fiber. Moreover, in the present application, the sheets and the layers are classified based on the length in the shaft axial direction.

In the present application, the layer disposed over the entire length in the shaft axial direction is referred to as a full length layer. In the present application, the sheet disposed over the entire length in the shaft axial direction is referred to as a full length sheet. A wound full length sheet forms a full length layer.

In the present application, the layer partially disposed in the shaft axial direction is referred to as a partial layer. In the present application, the sheet partially disposed in the shaft axial direction is referred to as a partial sheet. A wound partial sheet forms a partial layer. In the present application, the full length layer that is a straight layer is referred to as a full length straight layer. A wound full length straight sheet forms a full length straight layer. In the embodiment in FIG. 2, the full length straight sheets are the sheet s6, the sheet s7, and the sheet s9.

In the present application, the full length layer that is a hoop layer is referred to as a full length hoop layer. In the embodiment in FIG. 2, the full length hoop layer is a layer s8. The full length hoop sheet is the sheet s8.

In the present application, the partial layer that is a straight layer is referred to as a partial straight layer. In the embodiment in FIG. 2, the partial straight layers are the layer s1, a layer s4, a layer s5, a layer s10, and a layer s11. The partial straight sheets are the sheet s1, the sheet s4, the sheet s5, the sheet s10, and the sheet s11.

In the present application, the term "butt partial layer" is used. The butt partial layer includes a butt straight layer and a butt hoop layer. In the embodiment in FIG. 2, the butt straight layers are the layer s4 and the layer s5. The butt straight sheets are the sheet s4 and the sheet s5.

In the present application, the term "tip partial layer" is used. The tip partial layer includes a tip straight layer. In the embodiment in FIG. 2, the tip straight layers are the layer s1, the layer s10, and the layer s11. The tip straight sheets are the sheet s1, the sheet s10, and the sheet s11.

The shaft 6 is prepared by the sheetwinding method.

In the following, the outline of the manufacturing processes of the shaft 6 will be described.

[Outline of the Manufacturing Processes of the Shaft]

(1) Cutting Process

In the cutting process, the prepreg sheet is cut into a desired shape. In this process, the sheets illustrated in FIG. 2 are cut out.

The sheet may be cut using a cutter or may be cut manually. In the case of manual cutting, a cutter knife is used, for example.

(2) Stacking Process

In the stacking process, the foregoing two united sheets are prepared.

In the stacking process, heating or pressing may be used. More preferably, heating and pressing are combined. In the winding process described later, the sheets may be deviated in the winding operation of the united sheet. The deviation degrades winding accuracy. Heating and pressing improve the adhesive force between the sheets. Heating and pressing suppress the deviation between the sheets in the winding process.

(3) Winding Process

In the winding process, a mandrel is prepared. A typical mandrel is made of a metal. A mold release agent is applied to the mandrel. Moreover, a resin having tackiness is applied to the mandrel. The resin is also referred to as a tacking resin. The cut sheet is wound around the mandrel. The tacking resin facilitates the application of the sheet end part to the mandrel.

The sheets are wound in order from the sheets located on the upper side in the development view illustrated in FIG. 2. However, the sheets to be stacked are wound in the state of the united sheet.

In the winding process, a winding body can be obtained. The winding body is formed by winding the prepreg sheets on the outer side of the mandrel. Winding is achieved by rolling the wound object on a flat surface, for example. The winding may be made manually or by a machine. This machine is referred to as a rolling machine.

(4) Tape Wrapping Process

In the tape wrapping process, a tape is wound around the outer peripheral surface of the winding body. The tape is also referred to as a wrapping tape. The tape is wound while tension is applied. A pressure is applied to the winding body by the tape. The pressure decreases voids.

(5) Curing Process

In the curing process, the winding body is heated after a tape is wrapped to the winding body. The matrix resin is cured by the heating. In the curing process, the matrix resin is temporarily fluidized. Air between the sheets or in the sheet can be discharged by the fluidization of the matrix resin. The pressure (fastening force) of the wrapping tape promotes the discharge of the air. A cured laminate can be obtained by this curing.

(6) Mandrel Extracting Process and Wrapping Tape Removing Process

After the curing process, the mandrel extracting process and the wrapping tape removing process are performed. Although the order of these processes is not limited, from the viewpoint of improving the efficiency of the wrapping tape removing process, preferably, the wrapping tape removing process is performed after the mandrel extracting process.

(7) Process of Cutting Both Ends

In this process, the both end parts of the cured laminate are cut. The end face of the tip end Tp and the end face of the butt end Bt are made flat by this cutting.

For easy understanding, the development view in FIG. 2 illustrates the sheets in the state in which both ends are cut. Practically, in setting the dimensions of the sheets, cutting both ends is considered. That is, practically, the both end parts of the sheets are added with a portion that is cut in process of cutting both ends.

(8) Polishing Process

In this process, the surface of the cured laminate is polished. The surface of the cured laminate has spiral irregularities left as the trace of the wrapping tape. The irregularities as the trace of the wrapping tape are eliminated by polishing, and the surface is made smooth.

(9) Coating Process

The cured laminate after the polishing process is coated.

In the processes above, the shaft 6 is obtained. In the shaft 6, the ratio (Lg/Ls) is great. The shaft 6 is light-weighted.

The sheetwinding method is excellent in the degree of freedom for design. By the method, the ratio (Lg/Ls) can be easily adjusted. Items for adjusting the ratio (Lg/Ls) include (A1) to (A9) below.

(A1) The winding number of the butt partial layer
(A2) The number of the butt partial sheet
(A3) The thickness of the butt partial layer
(A4) The length of the butt partial layer in the axial direction
(A5) The winding number of the tip partial layer
(A6) The number of the tip partial sheet
(A7) The thickness of the tip partial layer
(A8) The length of the tip partial layer in the axial direction
(A9) The taper ratio of the shaft Items for adjusting the shaft flex include (B1) to (B8) below. The frequency of vibration of the club can be adjusted by adjusting the shaft flex.

(B1) The elastic modulus of fiber in the straight layer
(B2) The thickness of the straight layer
(B3) The winding number of the straight layer
(B4) The polishing amount in the polishing process
(B5) The length of the butt partial layer in the axial direction
(B6) The winding number of the butt partial layer
(B7) The length of the tip partial layer in the axial direction
(B8) The winding number of the tip partial layer In the embodiment, for the index of the ease of a swing, the inertia moment Ix is used. In the present application, the inertia moment Ix is referred to as the moment of inertia about the swing axis.

Conventionally, a swing balance (a club balance) is known as an index of the ease of a swing. However, the swing balance is a static moment, and not a dynamic index. On the other hand, a swing is dynamic. In the embodiment, for the index of the ease of a swing, the inertia moment Ix about the swing axis is used.

Figure 3:
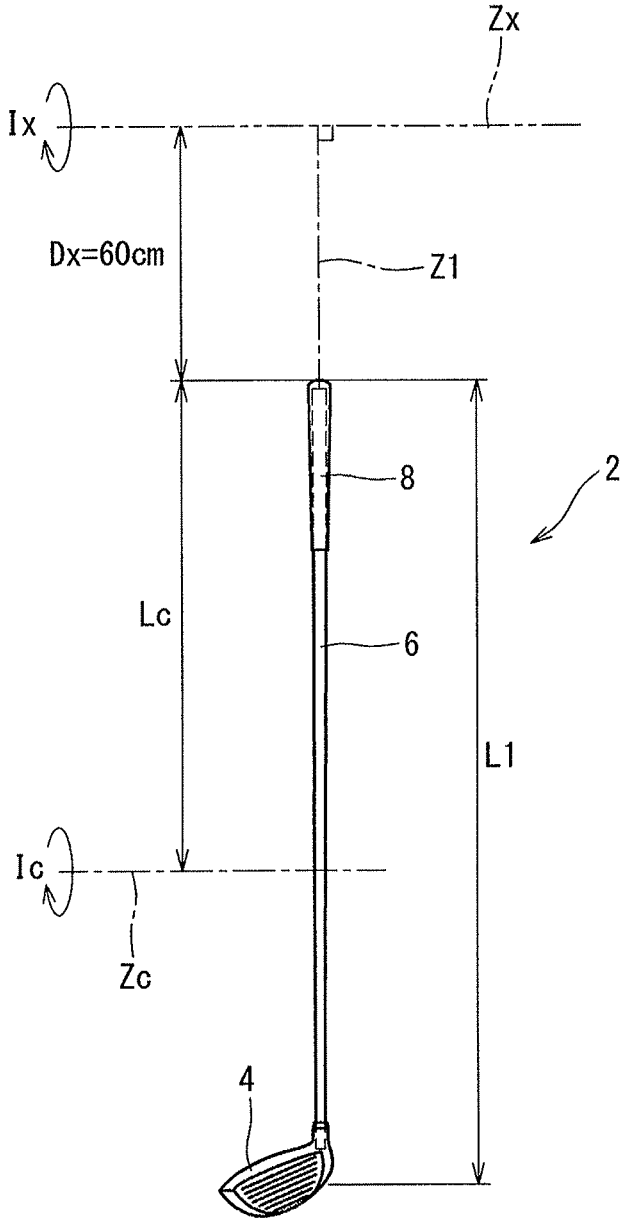
FIG. 3 is an illustration of the moment of inertia about a swing axis.

FIG. 3 is a diagram for explaining the inertia moment Ix and so on.

[Inertia Moment (Moment of Inertia) Ix]

The inertia moment Ix is calculated by Equation (1) below. Ix is the moment of inertia about the swing axis Zx.

$$Ix = Wc \times (Lc+60)^2 + Ic \quad (1)$$

In Equation (1) above, Wc is the club weight (kg), Lc is an axial direction distance from the grip end to the center of gravity (cm) of the club, and Ic is the moment of inertia ($kg \cdot cm^2$) about the center of gravity of the club. The unit of the inertia moment Ix is ($kg \cdot cm^2$).

In actual swings, the golf club is not rotated about the grip end. The golf club is rotated about the body of a golf player together with the arms of the golf player. In the present application, the swing axis Zx is set in consideration of the position of the body of the golf player when taking a swing. The swing axis is apart from the grip end. In order to evaluate the ease of a dynamic swing, a spacing Dx between the swing axis Zx and the grip end was set (see FIG. 3). As for the spacing Dx, many golf players' figures and swings were analyzed. For the golf player's figure, the arm length, for example, was considered. As a result, it was revealed that the spacing Dx was preferably about 60 cm. As described above, in consideration of the actual conditions of swings, the value [Lc+60] is used in Equation (1) above.

A swing is dynamic. As compared with the static index, the dynamic index can accurately reflect the ease of a swing. Moreover, as described above, the actual conditions of swings is considered for the inertia moment Ix. Therefore, the inertia moment Ix highly accurately reflects the ease of a swing. The ease of a swing contributes to the improvement of the head speed. The ease of a swing contributes to the improvement of the meeting ratio. Because of the ease of a swing, a flight distance can be increased.

The axis Zc illustrated in FIG. 3 is passed through the center of gravity of the club. The axis Zc is in parallel with the swing axis Zx. The inertia moment Ic is the moment of inertia of the club 2 about the axis Zc. The swing axis Zx is orthogonal to the shaft axis Z1. The axis Zc is orthogonal to the shaft axis Z1. In Equation (1) above, the moment Ix is calculated according to the parallel axis theorem.

In the present application, a reference state (not illustrated) is defined. The reference state is a state in which the sole of the club 2 is placed on a horizontal plane at a specified lie angle and a real loft angle. In the reference state, the shaft axis Z1 is included in a plane VP1 perpendicular to the horizontal plane. The plane VP1 is defined as a reference vertical plane. The Specified lie angles and real loft angles are described on product catalogs, for example. As apparent from FIG. 3, in the measurement of each of the moments of inertia, the face surface is in a substantially square state with respect to the head path. The orientation of the face surface is in the state of an ideal impact. The swing axis Zx is included in the reference vertical plane. That is, in the measurement of the inertia moment Ix, the swing axis Zx is included in the reference vertical plane. In the measurement of the inertia moment Ic, the axis Zc is included in the reference vertical plane. The foregoing moments of inertia reflect the attitude of the club near an impact. The foregoing moments of inertia reflect swings. Therefore, these moments of inertia have a high correlation with the ease of a swing. It is noted that the inertia moment Ic can be measured using MODEL NUMBER RK/005-002 made by INERTIA DYNAMICS Inc.

It is assumed that the center of gravity of the club is located on the shaft axis Z1. Because of the position of the center of gravity of the head, the real center of gravity of the club is slightly displaced from the shaft axis Z1. The real center of gravity of the club can be located in a space, for example. In the present application, it is assumed that a point on the axis Z1 closest to the real center of gravity of the club is the center of gravity of the club. In other words, the center of gravity of the club in the present application is an intersection point between the axis Z1 and a perpendicular line from the real center of gravity of the club to the axis Z1. The approximation of the position of the center of gravity of the club gives a slight difference to the value of the inertia moment Ix. However, the difference is so small that the difference does not affect the effects described in the present application.

From the viewpoint of the ease of a swing for advanced golf players whose head speed is relatively high, preferably, the inertia moment Ix is relatively great.

From the viewpoint of the ease of a swing for advanced golf players, the inertia moment Ix is preferably equal to or greater than $6.90\times10^3$ (kg·cm$^2$), more preferably equal to or greater than $7.15\times10^3$ (kg·cm$^2$), and still more preferably equal to or greater than $7.20\times10^3$ (kg·cm$^2$). An excessively large inertia moment Ix can decrease the head speed. From this viewpoint, the inertia moment Ix is preferably equal to or less than $7.50\times10^3$ (kg·cm$^2$), more preferably equal to or less than $7.45\times10^3$ (kg·cm$^2$), still more preferably equal to or less than $7.40\times10^3$ (kg·cm$^2$), and yet more preferably equal to or less than $7.35\times10^3$ (kg·cm$^2$).

A small inertia moment Ix can improve the ease of a swing. The ease of a swing contributes to the improvement of the head speed. For a method for decreasing the inertia moment Ix, it is considered to decrease the head weight Wh. However, when the head weight Wh is simply decreased, the kinetic energy of the head is decreased. In this case, the coefficient of restitution and the initial velocity of the ball are decreased.

In the embodiment, the ratio Wh/Wc is increased. That is, the ratio of the head weight Wh to the club weight Wc is increased. In the club weight Wc, the weight Wh allocated to the head is increased, so that the kinetic energy of the head can be increased. Therefore, the coefficient of restitution and the initial velocity of the ball can be improved.

In the embodiment, the inertia moment Ix is restricted to a predetermined range while the ratio Wh/Wc is increased. Therefore, although the head weight Wh is great, the ease of a swing is achieved. As a result, the head speed can be improved while the head weight Wh is increased. Because of the synergistic effect of the head weight Wh and the head speed, the initial velocity of the ball is increased, and the kinetic energy of the head is increased. Thus, the flight distance performance can be improved.

For the index of the ease of a swing, the club balance is generally used. In the case where the head weight Wh is increased, it is also likely to increase the club balance. Thus, it is considered that a decrease in the club balance is similar to a decrease in the head weight Wh. A technical idea (defined as technical idea A) is known that the ease of a swing is accompanied by a decrease in the head weight Wh. Conventionally, this technical idea A is a typical idea in a person skilled in the art. On the contrary, in the embodiment, a large part of the weight is allocated to the head while a swing is easily taken. Although this configuration is not matched with technical idea A, the configuration is effective in the improvement of a flight distance performance.

In the present application, the static moment of the club is defined as Mt. The static moment Mt is calculated by Equation (2) below. The unit of the static moment Mt is kg·cm.

$$Mt=Wc\times(Lc-35.6) \quad (2)$$

The static moment Mt corresponds to a 14-inch swing balance. The swing balance is a symbolized value of the static moment Mt.

From the viewpoint of the ease of a swing for advanced golf players, the static moment Mt is preferably equal to or greater than 16.3 kg·cm, more preferably equal to or greater than 16.4 kg·cm, and still more preferably equal to or greater than 16.7 kg·cm. In the case where the club length L1, for example, is set to a preferred value, the static moment Mt is preferably equal to or less than 18.0 kg·cm, more preferably equal to or less than 17.5 kg·cm, still more preferably equal to or less than 17.1 kg·cm, and yet more preferably, equal to or less than 17.0 kg·cm.

Preferably, the inertia moment Ix is small with respect to the static moment Mt. That is, preferably, the ratio (Ix/Mt) is small. In other words, preferably, the inertia moment Ix is small and the static moment Mt is great. With this configuration, the inertia moment Ix can be restricted while the center of gravity of the club is located close to the head. Therefore, the inertia moment Ix can be restricted while the ratio Wh/Wc is increased.

A decrease in the ratio Ix/Mt means that the inertia moment Ix is small while the static moment Mt is relatively great. In other words, this means that the inertia moment Ix is small while the club balance is relatively great. Therefore, the ratio Ix/Mt is decreased, and the ease of a swing tends to be improved while the club balance is relatively heavy. As described above, conventionally, the index of the ease of a swing is defined as the club balance. Conventionally, there is a technical idea that a swing is not easily taken if the club balance is heavy (technical idea B). Based on this technical idea B, it was not enabled to assume a concept that a swing is easily taken despite a heavy club balance.

In the case where the ratio Ix/Mt is small, a swing is easily taken although the static moment Mt is great. The ease of a swing can contribute to the improvement of the flight distance performance. From this viewpoint, the ratio Ix/Mt is preferably equal to or less than 442, more preferably equal to or less than 441, still more preferably equal to or less than 440, and yet more preferably equal to or less than 437. In consideration of the strength of the head, the shaft, and the grip, there is a limitation to decrease in the inertia moment Ix. In consideration of this point, the ratio Ix/Mt is preferably equal to or greater than 415, more preferably equal to or greater than 420, still more preferably equal to or greater than 425, and yet more preferably equal to or greater than 428.

[Wh/Wc]

In order to increase the kinetic energy of the head, preferably, the allocation ratio of the weight to the head is increased. From this viewpoint, the ratio Wh/Wc is preferably equal to or greater than 0.70, more preferably equal to or greater than 0.71, still more preferably equal to or greater than 0.72, and yet more preferably equal to or greater than 0.73. In consideration of the strength, for example, of the shaft and the grip, preferably, the shaft weight and the grip weight have a predetermined value or greater. From this viewpoint, the ratio Wh/Wc is preferably equal to or less than 0.80, more preferably equal to or less than 0.79, and still more preferably equal to or less than 0.78.

It is without saying that in the calculation of the ratio Wh/Wc, the unit is matched between the head weight Wh and the club weight Wc. For example, in the case where the unit of the head weight Wh is defined as "kg", the unit of the club weight Wc is also defined as "kg". In the case where the unit of the head weight Wh is defined as "g", the unit of the club weight Wc is also defined as "g".

If the ratio Wh/Wc is great, the flexure of the shaft is increased, and the behavior of the shaft becomes unstable. This unstable behavior can degrade the meeting ratio.

An excessively great flexure of the shaft during a swing may delay the timing of returning the flexure. This delay of the timing can degrade the head speed. It is not easy to take a swing using a club whose flexure is slowly returned.

From the viewpoint of the ease of a swing, preferably, an excessively great flexure caused by an increase in the ratio Wh/Wc is suppressed. From the viewpoint of the meeting ratio, preferably, an unstable behavior of the shaft caused by an increase in the ratio Wh/Wc is suppressed.

The frequency of vibration of the club is considered, so that the ease of a swing can be secured even though the ratio Wh/Wc is increased. The frequency of vibration of the club is considered, so that the behavior of the shaft can stabilize even though the ratio Wh/Wc is increased. From these viewpoints, the frequency of vibration of the club is preferably equal to or greater than 240 (cpm), more preferably equal to or greater than 245 (cpm), and more preferably equal to or greater than 250 (cpm). If the flexure is excessively small, the head speed and the ease of a swing are apt to decrease. From this viewpoint, the frequency of vibration of the club is preferably equal to or less than 280 (cpm), and more preferably equal to or less than 275 (cpm). The frequency of vibration of the club can be adjusted by the head weight Wh, the shaft flex, or the like.

[Head Weight Wh]

The kinetic energy of the head is increased, so that the initial velocity of a ball can be improved in hitting the ball. From this viewpoint, the head weight Wh is preferably equal to or greater than 190 g (0.190 kg), more preferably equal to or greater than 195 g (0.195 kg), still more preferably equal to or greater than 200 g (0.200 kg), and yet more preferably equal to or greater than 205 g (0.205 kg). From the viewpoint of the ease of a swing, the head weight Wh is preferably equal to or less than 250 g (0.250 kg), more preferably equal to or less than 245 g (0.245 kg), and still more preferably equal to or less than 240 g (0.240 kg).

[Shaft Weight Ws]

From the viewpoint of the strength and durability of the shaft, the shaft weight Ws is preferably equal to or greater than 35 g, more preferably equal to or greater than 38 g, and still more preferably equal to or greater than 40 g. From the viewpoint of the ease of a swing, the shaft weight Ws is preferably equal to or less than 65 g, more preferably equal to or less than 61 g, still more preferably equal to or less than 60 g, and yet more preferably equal to or less than 55 g.

[Grip Weight Wg]

From the viewpoint of the strength and durability of the grip, the grip weight Wg is preferably equal to or greater than 20 g, more preferably equal to or greater than 23 g, and still more preferably equal to or greater than 25 g. From the viewpoint of the ease of a swing, the grip weight is preferably equal to or less than 40 g, more preferably equal to or less than 38 g, and still more preferably equal to or less than 35 g. The grip weight Wg can be adjusted by the volume of the grip, the specific gravity of rubber, the use of expanded rubber, or the like.

[Shaft Length Ls]

From the viewpoint of improving the head speed by increasing the rotation radius of a swing, the shaft length Ls is preferably equal to or greater than 99 cm, more preferably equal to or greater than 105 cm, still more preferably equal to or greater than 107 cm, and yet more preferably equal to or greater than 110 cm. From the viewpoint of suppressing variation in points to hit, the shaft length Ls is preferably equal to or less than 120 cm, more preferably equal to or less than 118 cm, and more preferably equal to or less than 116 cm.

[Distance Lg]

The center of gravity G comes close to the butt end Bt, and the ease of a swing and the head speed can be improved. From this viewpoint, the distance Lg (see FIG. 1) is preferably equal to or greater than 540 mm, more preferably equal to or greater than 550 mm, still more preferably equal to or greater than 560 mm, yet more preferably equal to or greater than 570 mm, still yet more preferably equal to or greater than 580 mm, and still more preferably equal to or greater than 590 mm. In the case where the distance Lg is excessively large, since the weight that can be allocated to the tip end part of the shaft is decreased, the strength of the tip end part of the shaft is apt to decrease. From this viewpoint, the distance Lg is preferably equal to or less than 751 mm, more preferably equal to or less than 750 mm, still more preferably equal to or less than 745 mm, and yet more preferably equal to or less than 740 mm.

[Lg/Ls]

From the viewpoint of decreasing the inertia moment Ix about the swing axis while increasing the head weight Wh, the ratio Lg/Ls is preferably equal to or greater than 0.55, more preferably equal to or greater than 0.56, and still more preferably equal to or greater than 0.57. From the viewpoint of improving the strength of the tip end part of the shaft, the ratio Lg/Ls is preferably equal to or less than 0.67, more preferably equal to or less than 0.66, and still more preferably equal to or less than 0.65.

[Club Length L1]

From the viewpoint of improving the head speed, the club length L1 is preferably equal to or greater than 43 inches, more preferably equal to or greater than 44 inches, and still more preferably equal to or greater than 45 inches. From the viewpoint of suppressing variation in points to hit, the club length L1 is preferably equal to or less than 48 inches, more preferably equal to or less than 47.5 inches, and still more preferably equal to or less than 47 inches.

The club length L1 in the present application is measured based on the golf rule of "1c. Length" in "1. Clubs" of "Appendix II. Design of Clubs", defined by R&A (Royal and Ancient Golf Club of Saint Andrews).

In the wood type club, importance tends to be placed on the flight distance performance. The tendency is strong on drivers. From this viewpoint, preferably, the club is a driver. From the viewpoint of the flight distance performance, the real loft is preferably 7 degrees or greater and 13 degrees or less. From the viewpoint of the moment of inertia of the head, the volume of the head is preferably equal to or greater than 350 cc, more preferably equal to or greater than 380 cc, still more preferably equal to or greater than 400 cc, and yet more preferably equal to or greater than 420 cc. From the viewpoint of the strength of the head, preferably, the volume of the head is equal to or less than 470 cc.

[Club Weight Wc]

From the viewpoint of improving the ratio Wh/Wc, the club weight Wc is preferably equal to or less than 315 g (0.315 kg), more preferably equal to or less than 310 g (0.310 kg), still more preferably equal to or less than 300 g (0.300 kg), and yet more preferably equal to or less than 293 g (0.293 kg). From the viewpoint of the strength of the shaft and the head, the club weight Wc is preferably equal to or greater than 250 g (0.250 kg), more preferably equal to or greater than 260 g (0.260 kg), and still more preferably equal to or greater than 270 g (0.270 kg).

EXAMPLES

In the following, the effects of the present invention will be clarified by examples. However, the present invention should not be interpreted in a limited way based on the description of the examples. Table 1 shows examples of prepregs usable for the shaft according to the present invention.

TABLE 1

Examples of Usable Prepregs

| Manufacturer | Prepreg Sheet Product Number | Sheet Thickness (mm) | Fiber Content (% by mass) | Resin Content (% by mass) | Carbon Fiber Physical Property Value: Carbon Fiber Product Number | Tensile elastic modulus ($t/mm^2$) | Tensile Strength ($kgf/mm^2$) |
|---|---|---|---|---|---|---|---|
| Toray Industries, Inc. | 3255S-10 | 0.082 | 76 | 24 | T700S | 23.5 | 500 |
| Toray Industries, Inc. | 3255S-12 | 0.103 | 76 | 24 | T700S | 23.5 | 500 |
| Toray Industries, Inc. | 3255S-15 | 0.123 | 76 | 24 | T700S | 23.5 | 500 |
| Toray Industries, Inc. | 805S-3 | 0.034 | 60 | 40 | M30S | 30 | 560 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| Toray Industries, Inc. | 2256S-12 | 0.103 | 80 | 20 | T800S | 30 | 600 |
| Nippon Graphite Fiber Corporation | E1026A-09N | 0.100 | 63 | 37 | XN-10 | 10 | 190 |
| Mitsubishi Rayon Co., Ltd | TR350C-100S | 0.083 | 75 | 25 | TR50S | 24 | 500 |
| Mitsubishi Rayon Co., Ltd | TR350C-125S | 0.104 | 75 | 25 | TR50S | 24 | 500 |
| Mitsubishi Rayon Co., Ltd | TR350C-150S | 0.124 | 75 | 25 | TR50S | 24 | 500 |
| Mitsubishi Rayon Co., Ltd | MR350C-075S | 0.063 | 75 | 25 | MR40 | 30 | 450 |
| Mitsubishi Rayon Co., Ltd | MR350C-100S | 0.085 | 75 | 25 | MR40 | 30 | 450 |
| Mitsubishi Rayon Co., Ltd | MR350C-125S | 0.105 | 75 | 25 | MR40 | 30 | 450 |
| Mitsubishi Rayon Co., Ltd | MR350E-100S | 0.093 | 70 | 30 | MR40 | 30 | 450 |
| Mitsubishi Rayon Co., Ltd | HRX350C-075S | 0.057 | 75 | 25 | HR40 | 40 | 450 |
| Mitsubishi Rayon Co., Ltd | HRX350C-110S | 0.082 | 75 | 25 | HR40 | 40 | 450 |

The tensile strength and the tensile elastic modulus are measured in accordance with "Testing Method for Carbon Fibers" JIS R7601:1986.

Example 1

A shaft in a laminate configuration the same as the configuration of the shaft 6 was prepared. That is, a shaft in the configuration of the sheets illustrated in FIG. 2 was prepared. A manufacturing method was the same as the method for the shaft 6.

The shaft according to example 1 was formed using the prepregs shown in Table 1. The prepreg "HRX350C-110S" was used for the bias layer. The prepregs whose tensile elastic modulus was 23.5 to 30 ($t/mm^2$) was used for the straight layer. These prepregs are shown in Table 1. Prepregs were selected so as to have desired values for the frequency of vibration of the club, the shaft weight, the ratio Lg/Ls, or the like. The shaft according to example 1 was obtained by the manufacturing method described above.

The obtained shaft was attached with a commercially available driver head (SRIXON Z725 made by DUNLOP SPORTS CO., LTD.: a loft angle of 9.5 degrees) and a grip, and a golf club according to example 1 was obtained. Table 2 shows the specifications and evaluation result of example 1.

Examples 2 to 11 and Comparative Examples 1 to 11

Shafts and heads according to examples and comparative examples were obtained in the same manner as example 1 except the specifications shown in Tables 2 to 7 below.

In these examples and comparative examples, the head weight Wh was adjusted by polishing the overall outer surface of the head and using a weight adjustment adhesive. The adhesive was applied to the inner surface of the head. The adhesive is a thermoplastic adhesive, fixed to a predetermined position on the inner surface of the head at room temperature, and flows at high temperature. While the temperature of the adhesive was set at high temperature, the adhesive was poured into the head, and then cooled at ambient temperature for fixing. The adhesive was disposed so as not to change the position of the center of gravity of the head.

In the examples and comparative examples, the grip weight Wg was adjusted by the material of the grip. Expanded rubber was used for grips having a small weight Wg.

The shaft flex and the ratio (Lg/Ls) were adjusted based on the foregoing items (A1) to (A9) and (B1) to (B8). The specifications of the examples and the comparative examples were obtained using these adjustments. The specifications of the examples and comparative examples are shown in Tables 2 to 7 below.

It is noted that in Tables, example 2 is described at a plurality of places for easy comparison of data.

TABLE 2

Specifications and Evaluation Results of Examples and Comparative Examples

| | Comparative Example 1 | Example 1 | Example 2 | Example 3 | Comparative Example 2 |
|---|---|---|---|---|---|
| Club Weight Wc (g) | 275.7 | 285.7 | 292.9 | 300.0 | 304.3 |
| Club Length L1 (inch) | 45 | 45 | 45 | 45 | 45 |
| Club Inertia Moment Ix about Swing Axis (kg · cm$^2$) | 6850 | 7100 | 7300 | 7500 | 7600 |
| Ix/Mt | 439 | 436 | 437 | 439 | 439 |
| Static Moment Mt (kg · cm) | 15.6 | 16.3 | 16.7 | 17.1 | 17.3 |
| Frequency of Vibration of Club (cpm) | 260 | 260 | 260 | 260 | 260 |
| Head Weight Wh (g) | 193 | 200 | 205 | 210 | 213 |
| Wh/Wc | 0.70 | 0.70 | 0.70 | 0.70 | 0.70 |
| Shaft Weight Ws (g) | 55.7 | 58.7 | 60.9 | 63.0 | 64.3 |
| Shaft Length Ls (mm) | 1121 | 1121 | 1121 | 1121 | 1121 |
| Distance Lg from Tip to Center of Gravity of Shaft (mm) | 617 | 617 | 617 | 617 | 617 |
| Distance from Butt to Center of Gravity of Shaft (mm) | 504 | 504 | 504 | 504 | 504 |
| Lg/Ls | 0.55 | 0.55 | 0.55 | 0.55 | 0.55 |
| Grip Weight Wg (g) | 25 | 25 | 25 | 25 | 25 |
| Head Speed (m/s) | 46.0 | 45.6 | 45.0 | 44.5 | 43.7 |
| Kinetic Energy (J) | 204.2 | 207.9 | 207.6 | 207.9 | 203.4 |
| Flight distance (yards) | 261 | 268 | 268 | 268 | 261 |
| Shaft Durability | A | A | A | A | A |

TABLE 3

Specifications and Evaluation Results of Examples and Comparative Example

| | Comparative Example 3 | Example 2 | Example 4 |
|---|---|---|---|
| Club Weight Wc (g) | 301.5 | 292.9 | 284.7 |
| Club Length L1 (inch) | 45 | 45 | 45 |
| Club Inertia Moment Ix about Swing Axis (kg · cm$^2$) | 7450 | 7300 | 7250 |
| Ix/Mt | 443 | 437 | 437 |
| Static Moment Mt (kg · cm) | 16.8 | 16.7 | 16.6 |
| Frequency of Vibration of Club (cpm) | 260 | 260 | 260 |
| Head Weight Wh (g) | 205 | 205 | 205 |
| Wh/Wc | 0.68 | 0.70 | 0.72 |
| Shaft Weight Ws (g) | 69.5 | 60.9 | 52.7 |
| Shaft Length Ls (mm) | 1121 | 1121 | 1121 |
| Distance Lg from Tip to Center of Gravity of Shaft (mm) | 617 | 617 | 617 |
| Distance from Butt to Center of Gravity of Shaft (mm) | 504 | 504 | 504 |
| Lg/Ls | 0.55 | 0.55 | 0.55 |
| Grip Weight Wg (g) | 25 | 25 | 25 |
| Head Speed (m/s) | 44.6 | 45.0 | 45.2 |
| Kinetic Energy (J) | 203.9 | 207.6 | 209.4 |
| Flight distance (yards) | 263 | 268 | 270 |
| Shaft Durability | A | A | A |

TABLE 4

Specifications and Evaluation Results of Examples and Comparative Example

| | Example 5 | Example 2 | Example 6 | Comparative Example 4 |
|---|---|---|---|---|
| Club Weight Wc (g) | 292.9 | 292.9 | 292.9 | 292.9 |
| Club Length L1 (inch) | 45 | 45 | 45 | 45 |
| Club Inertia Moment Ix about Swing Axis (kg · cm$^2$) | 7450 | 7300 | 7150 | 7100 |
| Ix/Mt | 441 | 437 | 439 | 441 |
| Static Moment Mt (kg · cm) | 16.9 | 16.7 | 16.3 | 16.1 |
| Frequency of Vibration of Club (cpm) | 260 | 260 | 260 | 260 |
| Head Weight Wh (g) | 205 | 205 | 205 | 205 |
| Wh/Wc | 0.70 | 0.70 | 0.70 | 0.70 |
| Shaft Weight Ws (g) | 60.9 | 60.9 | 60.9 | 60.9 |
| Shaft Length Ls (mm) | 1121 | 1121 | 1121 | 1121 |
| Distance Lg from Tip to Center of Gravity of Shaft (mm) | 594 | 617 | 751 | 773 |
| Distance from Butt to Center of Gravity of Shaft (mm) | 527 | 504 | 370 | 348 |
| Lg/Ls | 0.53 | 0.55 | 0.67 | 0.69 |
| Grip Weight Wg (g) | 25 | 25 | 25 | 25 |
| Head Speed (m/s) | 44.6 | 45.0 | 45.5 | 45.6 |
| Kinetic Energy (J) | 203.9 | 207.6 | 212.2 | 213.1 |
| Flight distance (yards) | 263 | 268 | 274 | 275 |
| Shaft Durability | A | A | A | B |

TABLE 5

Specifications and Evaluation Results of Example and Comparative Example

| | Example 7 | Comparative Example 5 |
|---|---|---|
| Club Weight Wc (g) | 292.9 | 292.9 |
| Club Length L1 (inch) | 45 | 45 |
| Club Inertia Moment Ix about Swing Axis (kg · cm$^2$) | 7200 | 7150 |
| Ix/Mt | 442 | 450 |
| Static Moment Mt (kg · cm) | 16.3 | 15.9 |

TABLE 5-continued

| Specifications and Evaluation Results of Example and Comparative Example | Example 7 | Comparative Example 5 |
|---|---|---|
| Frequency of Vibration of Club (cpm) | 260 | 260 |
| Head Weight Wh (g) | 205 | 205 |
| Wh/Wc | 0.70 | 0.70 |
| Shaft Weight Ws (g) | 45.9 | 40.9 |
| Shaft Length Ls (mm) | 1121 | 1121 |
| Distance Lg from Tip to Center of Gravity of Shaft (mm) | 617 | 617 |
| Distance from Butt to Center of Gravity of Shaft (mm) | 504 | 504 |
| Lg/Ls | 0.55 | 0.55 |
| Grip Weight Wg (g) | 40 | 45 |
| Head Speed (m/s) | 45.3 | 45.5 |
| Kinetic Energy (J) | 210.3 | 212.2 |
| Flight distance (yards) | 271 | 274 |
| Shaft Durability | A | B |

TABLE 6

| Specifications and Evaluation Results of Examples and Comparative Examples | Comparative Example 6 | Example 8 | Example 2 | Example 9 | Comparative Example 7 |
|---|---|---|---|---|---|
| Club Weight Wc (g) | 292.9 | 292.9 | 292.9 | 292.9 | 292.9 |
| Club Length L1 (inch) | 45 | 45 | 45 | 45 | 45 |

TABLE 6-continued

| Specifications and Evaluation Results of Examples and Comparative Examples | Comparative Example 6 | Example 8 | Example 2 | Example 9 | Comparative Example 7 |
|---|---|---|---|---|---|
| Club Inertia Moment Ix about Swing Axis (kg · cm$^2$) | 7300 | 7300 | 7300 | 7300 | 7300 |
| Ix/Mt | 437 | 437 | 437 | 437 | 437 |
| Static Moment Mt (kg · cm) | 16.7 | 16.7 | 16.7 | 16.7 | 16.7 |
| Frequency of Vibration of Club (cpm) | 230 | 240 | 260 | 280 | 290 |
| Head Weight Wh (g) | 205 | 205 | 205 | 205 | 205 |
| Wh/Wc | 0.70 | 0.70 | 0.70 | 0.70 | 0.70 |
| Shaft Weight Ws (g) | 60.9 | 60.9 | 60.9 | 60.9 | 60.9 |
| Shaft Length Ls (mm) | 1121 | 1121 | 1121 | 1121 | 1121 |
| Distance Lg from Tip to Center of Gravity of Shaft (mm) | 617 | 617 | 617 | 617 | 617 |
| Distance from Butt to Center of Gravity of Shaft (mm) | 504 | 504 | 504 | 504 | 504 |
| Lg/Ls | 0.55 | 0.55 | 0.55 | 0.55 | 0.55 |
| Grip Weight Wg (g) | 25 | 25 | 25 | 25 | 25 |
| Head Speed (m/s) | 44.9 | 45.1 | 45.0 | 44.9 | 44.2 |
| Kinetic Energy (J) | 206.6 | 208.5 | 207.6 | 206.6 | 200.2 |
| Flight distance (yards) | 261 | 268 | 268 | 268 | 258 |
| Shaft Durability | A | A | A | A | A |

TABLE 7

| Specifications and Evaluation Results of Examples and Comparative Examples | Comparative Example 8 | Comparative Example 9 | Example 10 | Example 2 | Comparative Example 10 | Example 11 | Comparative Example 11 |
|---|---|---|---|---|---|---|---|
| Club Weight Wc (g) | 321.4 | 292.9 | 314.3 | 292.9 | 292.9 | 271.4 | 271.4 |
| Club Length L1 (inch) | 42 | 43 | 43 | 45 | 48 | 48 | 49 |
| Club Inertia Moment Ix about Swing Axis (kg · cm$^2$) | 7400 | 6900 | 7450 | 7300 | 7950 | 7350 | 7500 |
| Ix/Mt | 451 | 445 | 446 | 437 | 430 | 432 | 429 |
| Static Moment Mt (kg · cm) | 16.4 | 15.5 | 16.7 | 16.7 | 18.5 | 17.0 | 17.5 |
| Frequency of Vibration of Club (cpm) | 260 | 260 | 260 | 260 | 260 | 260 | 260 |
| Head Weight Wh (g) | 225 | 205 | 220 | 205 | 205 | 190 | 190 |
| Wh/Wc | 0.70 | 0.70 | 0.70 | 0.70 | 0.70 | 0.70 | 0.70 |
| Shaft Weight Ws (g) | 69.4 | 60.9 | 67.3 | 60.9 | 60.9 | 54.4 | 54.4 |
| Shaft Length Ls (mm) | 1045 | 1070 | 1070 | 1121 | 1197 | 1197 | 1222 |
| Distance Lg from Tip to Center of Gravity of Shaft (mm) | 575 | 589 | 589 | 617 | 658 | 658 | 672 |
| Distance from Butt to Center of Gravity of Shaft (mm) | 470 | 482 | 482 | 504 | 539 | 539 | 550 |
| Lg/Ls | 0.55 | 0.55 | 0.55 | 0.55 | 0.55 | 0.55 | 0.55 |
| Grip Weight Wg (g) | 25 | 25 | 25 | 25 | 25 | 25 | 25 |
| Head Speed (m/s) | 42.3 | 44.6 | 43.5 | 45.0 | 45.1 | 46.7 | 46.8 |
| Kinetic Energy (J) | 201.3 | 203.9 | 208.1 | 207.6 | 208.5 | 207.2 | 208.1 |
| Flight distance (yards) | 260 | 263 | 268 | 268 | 250 | 267 | 250 |
| Shaft Durability | A | A | A | A | A | A | A |

[Frequency of Vibration of the Club]

Figure 4:
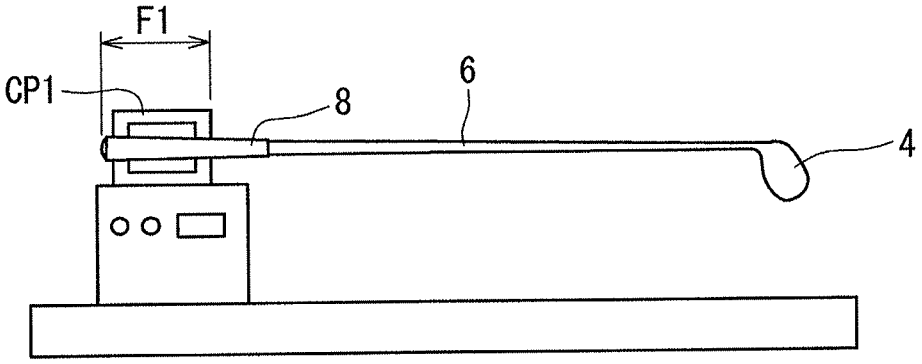
FIG. 4 is a diagram of a method for measuring the frequency of vibration of a club.

"GOLF CLUB TIMING HARMONIZER" (trade name) made by Fujikura Rubber Ltd. was used for measuring the frequency of vibration of the club. FIG. 4 is a diagram for explaining a measuring method of the frequency of vibration of the club. A portion at a point 7 inches from the grip end to the grip end was fixed using a clamp CP1. That is, a length F1 of the fixed portion was 7 inches (about 178 mm). A given load was applied to the head 4 downward, and the shaft 6 was vibrated. The frequency of vibration per minute is the frequency of vibration of the club (cpm). The measured values are shown in Tables 2 to 7 above.

[Moment of Inertia]

The inertia moment Ix was calculated by Equation (1) described above. The club inertia moment Ic was measured using MODEL NUMBER RK/005-002 made by INERTIA DYNAMICS Inc.

[Head Speed]

Five testers whose handicaps were 0 or greater and 10 or less conducted the evaluation. The general head speeds of these five testers were 42 to 48 (m/s). The head speeds of the five testers are relatively high. Each tester hits a ball with each club for ten times. Therefore, hits were made for 50 times for the each of the clubs in total. In the hits, the head speed was measured in impact. The mean values of 50 items of data are shown in Tables 2 to 7.

[Kinetic Energy]

The kinetic energy (J) was calculated using the mean value of the obtained head speed. The calculated values are shown in Tables 2 to 7. The calculation equation of the kinetic energy K is as follows, if the head weight is defined as Wh, and the head speed (the mean value) is defined as Vh.

$$K=Wh\times(Vh)^2/2$$

[Flight Distance]

From the viewpoint of improving the reliability of data, two hits of small flight distances were not adopted in the ten hits described above. As a result, 40 items of data for flight distance data were obtained. It is noted that this flight distance is a distance (a so-called carry) to a spot where a ball falls to the ground. The mean values of 40 items of data are shown in Tables 2 to 7.

[Shaft Durability]

The club was mounted on a swing robot made by Miyamae Co., Ltd., and the head speed was set at 52 m/s. A point to hit was at a location 20 mm apart from the face center to the heel side. "DDH TOUR SPECIAL" made by DUNLOP SPORTS CO., LTD. was used as the golf ball. The ball was repeatedly hit, and the state of the shaft was confirmed for every 500 hits. The shaft was evaluated as "A" in the case where the shaft was not damaged after 10,000 hits. In the case where breakage was confirmed before 10,000 hits, the shaft was evaluated as "B". These evaluations are shown in Tables 2 to 7.

In the case where the static moment Mt was small, the head weight Wh was decreased and a flight distance was short (see comparative example 1 in Table 2).

In the case where the inertia moment Ix was excessively great, the head speed was less increased, and a flight distance was short (see comparative example 2 in Table 2).

In the case where the ratio (Wh/Wc) of the head weight Wh was excessively small, the kinetic energy was decreased and a flight distance was short (see comparative example 3 in Table 3).

In the case where the center of gravity G of the shaft was located close to the head and the ratio (Lg/Ls) was small, the inertia moment Ix was relatively great although the head weight Wh was not great. Therefore, the kinetic energy was small and a flight distance is short (see example 5 in Table 4).

In the case where the center of gravity G of the shaft was located close to the butt end Bt and the ratio (Lg/Ls) was great, the strength of the tip end part of the shaft was apt to decrease (see comparative example 4 in Table 4).

In the case where the shaft weight Ws was small in the club weight Wc, the strength of the shaft was apt to decrease (see comparative example 5 in Table 5).

In the case where the frequency of vibration of the club was excessively small, the behavior of the shaft became unstable during a swing and the meeting ratio was apt to decrease. Therefore, a flight distance was short (see comparative example 6 in Table 6). The meeting ratio means a probability that a ball is hit at a sweet spot.

In the case where the frequency of vibration of the club was excessively great, the flexure of the shaft was small, and the head speed was decreased. Thus, a flight distance was short (see comparative example 7 in Table 6).

In the case where the club length L1 was excessively small, the rotation radius of a swing was small and the head speed was apt to decrease. Thus, the head speed was low and a flight distance was short (see comparative example 8 in Table 7).

As a result that the club length L1 is short and the head weight Wh was small, the static moment Mt could be excessively small. In this case, the head speed was low and the kinetic energy was also small. Therefore, a flight distance was short (see comparative example 9 in Table 7).

As a result that the club length L1 was great, the inertia moment Ix could be excessively great. In this case, the head speed was not increased although the club length L1 was relatively great, and the meeting ratio was small. Thus, a flight distance was short (see comparative example 10 in Table 7).

In the case where the club length L1 was excessively great, the meeting ratio was decreased and a flight distance was short (see comparative example 11 in Table 7).

As shown in Tables, the superiority of the present invention is apparent.

The method described above is applicable to golf clubs.

The description above is merely an example, and can be variously modified within the scope not deviating from the principles of the present invention.

What is claimed is:

1. A golf club comprising:

a head having a head weight defined as Wh (kg);

a shaft comprising a grip end, a tip end opposite of the grip end, and a shaft axis extending in an axial direction;

a grip;

a club weight defined as Wc (kg);

an axial direction distance between the grip end of the shaft and a center of gravity of the golf club defined as Lc (cm);

a club inertia moment about the center of gravity of the golf club Ic (kg·cm$^2$);

an inertia moment about a swing axis Ix (kg·cm$^2$) calculated by formula (1):

$$Ix=Wc\times(Lc+60)^2+Ic \quad (1); \text{ and}$$

a static moment defined as Mt (kg·cm) and calculated by the following formula (2):

$$Mt=Wc\times(Lc-35.6) \quad (2),$$

wherein:

Mt is greater than or equal to 16.7 kg cm; and a ratio Ix/Mt is equal to or less than 442 cm.

2. The golf club according to claim 1, wherein the inertia moment Ix about a swing axis is $6.90\times10^3$ (kg·cm$^2$) or greater and $7.50\times10^3$ (kg·cm$^2$) or less.

3. The golf club according to claim 2, wherein a ratio (Wh/Wc) between a head weight Wh and a club weight Wc is equal to or greater than 0.70.

4. The golf club according to claim 3, further comprising:

an axial direction distance between the tip end of the shaft to a center of gravity of the shaft defined as Lg (cm); and a shaft length defined as Ls (cm);

wherein a ratio Lg/Ls is greater than or equal to 0.55 and less than or equal to 0.67.

5. The golf club according to claim 3, wherein a weight of the grip is less than 40 g.

6. The golf club according to claim 3, wherein:

the ratio Wh/Wc is less than or equal to 0.80; and the Mt is less than or equal to 18.0 kg·cm.

7. The golf club according to claim 3, further comprising a frequency of vibration that is 250 cpm or greater and 280 cpm or less.

8. The golf club according to claim 1, wherein a weight of the grip is less than 35 g.

9. A golf club comprising:

a head having a head weight defined as Wh (kg);

a shaft comprising a grip end, a tip end opposite of the grip end, and a shaft axis extending in an axial direction;

a grip;

a club weight defined as Wc (kg);

a club length greater than or equal to 43 in and less than or equal to 48 in;

an axial direction distance between the grip end of the shaft and a center of gravity of the golf club defined as Lc (cm);

a club inertia moment about the center of gravity of the golf club Ic (kg·cm$^2$);

an inertia moment about a swing axis Ix (kg·cm$^2$) calculated by formula (1):

$$Ix=Wc\times(Lc+60)^2+Ic \quad (1), \text{ and}$$

a static moment defined as Mt (kg·cm) and calculated by the following formula (2):

$$Mt=Wc\times(Lc-35.6) \quad (2),$$

wherein:

Mt is greater than or equal to 16.7 kg·cm; and a ratio Ix/Mt is equal to or less than 442 cm.

10. The golf club according to claim 9, wherein the inertia moment Ix about a swing axis is $6.90\times10^3$ (kg·cm$^2$) or greater and $7.50\times10^3$ (kg·cm$^2$) or less.

11. The golf club according to claim 10, wherein a ratio (Wh/Wc) between a head weight Wh and a club weight We is equal to or greater than 0.70.

12. The golf club according to claim 11, wherein a weight of the grip is less than 40 g.

13. The golf club according to claim 9, wherein a weight of the grip is less than 35 g.

14. The golf club according to claim 11, wherein Wh is greater than or equal to 0.190 kg.

15. The golf club according to claim 11, wherein:

the ratio Wh/Wc is less than or equal to 0.80; and the Mt is less than or equal to 18.0 kg·cm.

16. The golf club according to claim 11, further comprising:

an axial direction distance between the tip end of the shaft to a center of gravity of the shaft defined as Lg (cm); and a shaft length defined as Ls (cm);

wherein a ratio Lg/Ls is greater than or equal to 0.55 and less than or equal to 0.67.

17. A golf club comprising:

a head having a head weight defined as Wh (kg) and a volume greater than or equal to 420 cc;

a shaft comprising a grip end, a tip end opposite of the grip end, and a shaft axis extending in an axial direction;

a grip;

a club weight defined as Wc (kg);

an axial direction distance between the grip end of the shaft and a center of gravity of the golf club defined as Lc (cm);

a club inertia moment about the center of gravity of the golf club Ic (kg·cm$^2$);

an inertia moment about a swing axis Ix (kg·cm$^2$) calculated by formula (1):

$$Ix=Wc\times(Lc+60)^2+Ic \quad (1); \text{ and}$$

a static moment defined as Mt (kg·cm) and calculated by the following formula (2):

$$Mt=Wc\times(Lc-35.6) \quad (2),$$

wherein:

Mt is greater than or equal to 16.7 kg·cm; and a ratio Ix/Mt is equal to or less than 442 cm.

18. The golf club according to claim 17, wherein the inertia moment Ix about a swing axis is $6.90\times10^3$ (kg·cm$^2$) or greater and $7.50\times10^3$ (kg·cm$^2$) or less.

19. The golf club according to claim 18, wherein a ratio (Wh/Wc) between a head weight Wh and a club weight Wc is equal to or greater than 0.70.

20. The golf club according to claim 19, further comprising:

an axial direction distance between the tip end of the shaft to a center of gravity of the shaft defined as Lg (cm); and a shaft length defined as Ls (cm);

wherein a ratio Lg/Ls is greater than or equal to 0.55 and less than or equal to 0.67.

* * * * *